US006808327B2

(12) United States Patent
Iwata

(10) Patent No.: US 6,808,327 B2
(45) Date of Patent: Oct. 26, 2004

(54) REMOVABLE PRINTER UNIT

(75) Inventor: Yoshikiki Iwata, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 10/365,325

(22) Filed: Feb. 11, 2003

(65) Prior Publication Data

US 2003/0156881 A1 Aug. 21, 2003

(30) Foreign Application Priority Data

Feb. 15, 2002 (JP) ..... 2002-037980

(51) Int. Cl.[7] ..... B41J 29/02; B41J 29/12; B41J 3/39

(52) U.S. Cl. ..... 400/693; 400/692; 400/613; 400/82; 235/7 R

(58) Field of Search ..... 400/88, 91, 92, 400/693, 82; 235/7 R, 613, 692

(56) References Cited

U.S. PATENT DOCUMENTS 5,044,801 A * 9/1991 Uchimura et al. ..... 400/592
5,137,385 A * 8/1992 Kamimura et al. ..... 400/690.4
5,320,437 A * 6/1994 Malke et al. ..... 400/605
5,707,162 A * 1/1998 Kasai et al. ..... 400/692
6,004,053 A * 12/1999 Petteruti et al. ..... 400/693
6,030,133 A * 2/2000 Endo ..... 400/82

* cited by examiner

*Primary Examiner*—Andrew H. Hirshfeld
*Assistant Examiner*—Marissa Ferguson
(74) *Attorney, Agent, or Firm*—Frishauf, Holtz, Goodman & Chick, P.C.

(57) ABSTRACT

A printer unit for facilitating maintenance such as repair/replacement of a printer paper winding mechanism and reducing a work time required for the maintenance. The printer unit is mounted removably on a device that requires the printer unit. It comprises a journal printer 4 and a pulley 8 that winds paper P printed by the printer. The printer unit also comprises a body 110 to which the printer is fixed and having a paper shed 3 in which the paper is stored, and a turning arm 140 assembled at one end rotatably with the body 110. The turning arm 140 has thereon the winding pulley 8 and a platen 143 that is bringable to a position opposite to the printer.

11 Claims, 16 Drawing Sheets

REMOVABLE PRINTER UNIT

BACKGROUND OF THE INVENTION

1. Field of the Invention

The present invention relates to a printer unit mountable on a device that requires the printer unit.

2. Background Art

A cash register is provided with a journal-paper winding mechanism that saves a journal on which characters are printed by a printer.

FIG. 16 shows a conventional journal paper winding mechanism provided on a cash register. Reference numeral 1 denotes a cash register (device), 2 a drawer, 3 a roll of paper shed, 4 a journal printer, 5 a printer fixing stand, 6 a writing stand, 7 a winding motor, 8 a winding pulley, and P a roll of printing paper.

A part of a roll of (journal) paper P printed by the journal printer 4 is wound by the winding pulley 8 through the writing stand 6 disposed above the journal printer 4.

As shown in FIGS. 17 and 18, the winding pulley 8 has a frictional wheel 81 coaxial with the winding pulley 8 with a rubber roller 71 provided on a shaft of the winding motor 7 engaging the outer periphery of the frictional wheel 81.

Therefore, when driving the winding motor 7, the winding pulley 8 winds the roll of paper through the rubber roller 71 and the frictional wheel 81.

When a part of the journal paper P fed out from the journal printer 4 is wound on the winding pulley 8 by the motor 7, the journal paper winding mechanism has the following problems:

The feeding speed of the journal paper P determined by the journal printer 4 is not synchronized with the rotational speed of the winding pulley 8 determined by the winding motor 7. If the winding speed determined by the motor 7 is higher than the rotational speed of the pulley 8, there occurs friction between the winding motor 7 and the pulley 8 to thereby produce abnormal noise and/or abrasion of the rubber roller 71. As a result, maintenance such as repair/replacement of the winding mechanism must be performed frequently.

When such maintenance is, however, difficult to perform and time consuming because the winding mechanism is fixed to the cash register in such a manner that it cannot be removed easily.

It is an object of the present invention to provide a printer unit capable of easily doing in a reduced time maintenance work such as repair and/or replacement of the printer paper winding mechanism.

SUMMERY OF THE INVENTION

In order to achieve the above object, according to one aspect of the present invention, there is provides a printer unit mountable on a device that requires the printer unit and comprising a printer and a pulley that winds paper printed by the printer, the printer unit also comprising:

- a body to which the printer is fixed and having a paper shed in which the paper is stored, and
- a turning arm assembled at one end rotatably with the body, the turning arm having thereon the winding pulley and a platen that is bringable to a position opposite to the printer.

Therefore, according to this invention, maintenance work such as repair/replacement of the printer paper winding mechanism is easily done and the work time for the maintenance is reduced.

According to another aspect of the present invention, there is also provided a printer unit attachable to a drawer provided in a cash register, the printer unit comprising a printer and a winding pulley that winds paper printed by the printer, the printer unit also comprising:

- a paper shed for storing the paper to be fed to the printer;
- a hook for fixing the drawer;
- fixing means for fixing the printer; and
- a turning arm having thereon a platen bringable to a position opposite to the printer, and the winding pulley, turning arm being assembled at one end with the printer unit.

Therefore, according to this invention, maintenance work such as repair/replacement of the printer paper winding mechanism is easily done and the work time for the maintenance is reduced in the cash register.

DETAILED DESCRIPTION OF THE PREFERRED EMBODIMENTS

Referring to FIGS. 1–6, a first embodiment of the present invention, that is, a journal printer to be provided in a cash register as mentioned above will be described as an example.

<Example 1 of the Structure of a Paper Winding Mechanism>

Figure 1:
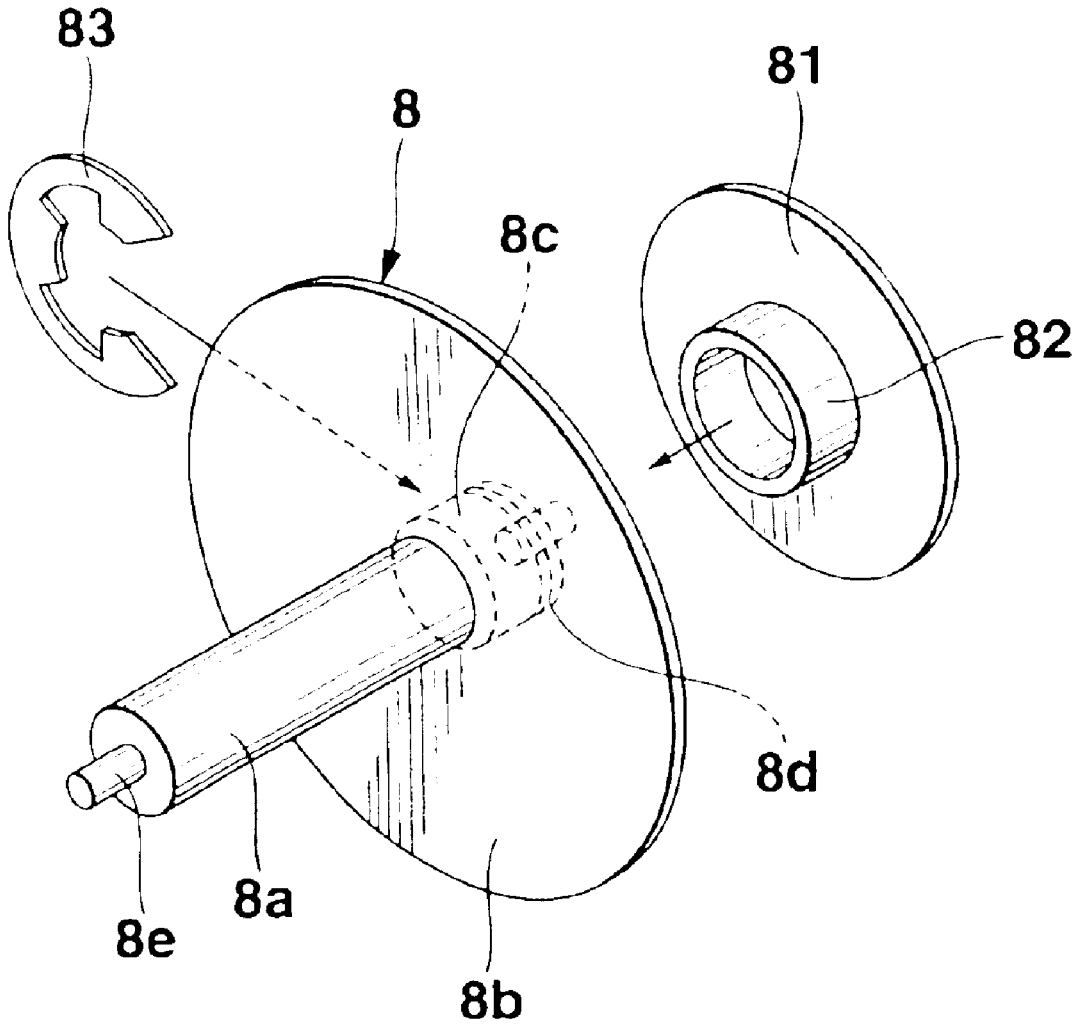
FIG. 1 is a disassembled perspective view of an example 1 of a paper winding mechanism.

As shown in FIG. 1, a winding pulley 8 has a shaft 8*a* and a larger end 8*c* between which a flange 8*b* is provided. The larger end 8*c* has a ring-like groove 8*d* extending along its outer periphery. The pulley shaft 8*a* also has a reduced end 8*e* at its other end.

Figure 2:
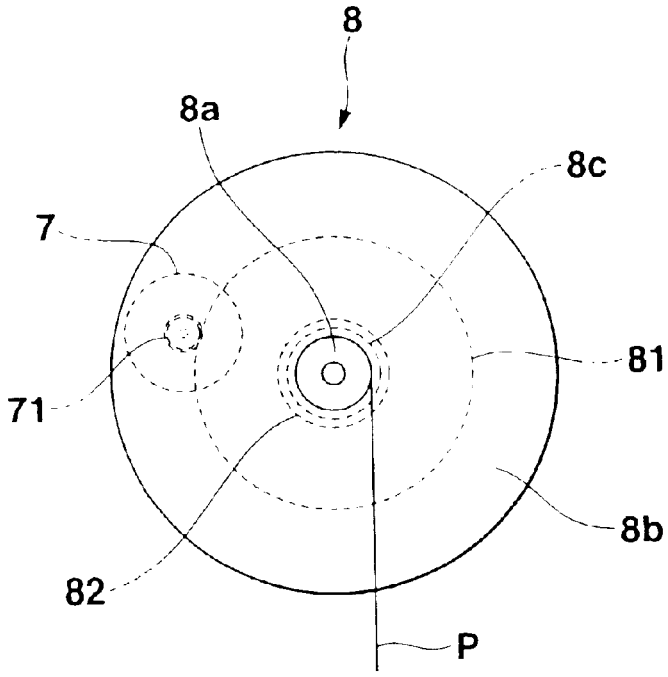
FIG. 2 is a side view of the winding mechanism, showing the positional relationship between the motor and other elements.
Figure 3:
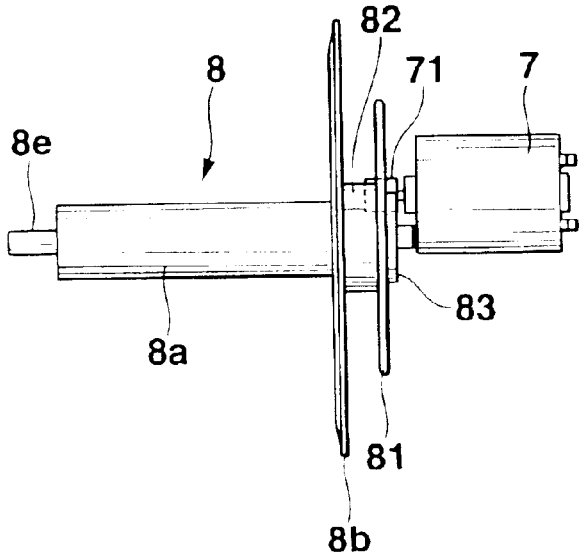
FIG. 3 is a plan view of the winding mechanism.

A frictional wheel 81 that functions as a rotation transmission element to the winding pulley 8 has a coaxial hollow cylinder 82 that fits rotatably over the larger shaft end 8*c* of the pulley 8, as shown in FIGS. 2 and 3. An E-like ring 83 is fitted in the ring-like groove 8*d* on the outer periphery of the larger shaft end 8*c* in order to prevent the frictional wheel 81 from slipping off from the winding pulley 8.

Operation of the journal paper winding mechanism, as described above, will be described next. During operation of the journal printer 4 of FIG. 5, the winding motor 7 is also driven. There occurs a difference between the feeding speed of journal paper P by the journal printer 4 and the winding speed of the journal paper P determined by rotation of the winding pulley 8 transmitted through a rubber roller 71 and the frictional wheel 81 from the winding motor 7.

More specifically, when the winding speed of the journal paper P is higher than its feeding speed, no slip occurs between the rubber roller 71 and the frictional wheel 81. When the winding speed of the journal paper P is lower than its feeding speed, a slip occurs between the frictional wheel 81 and the winding pulley 8 such that the hollow cylinder portion 82 of the frictional wheel 81 of FIG. 1 rotates over the larger shaft end 8*c* of the winding pulley 8 while slipping. Thus, the magnitude of abnormal noise to be produced and abrasion of the rubber roller 71 as the problems with the prior art are reduced.

<Example 2 of the Structure of the Paper Winding Mechanism>

Figure 4:
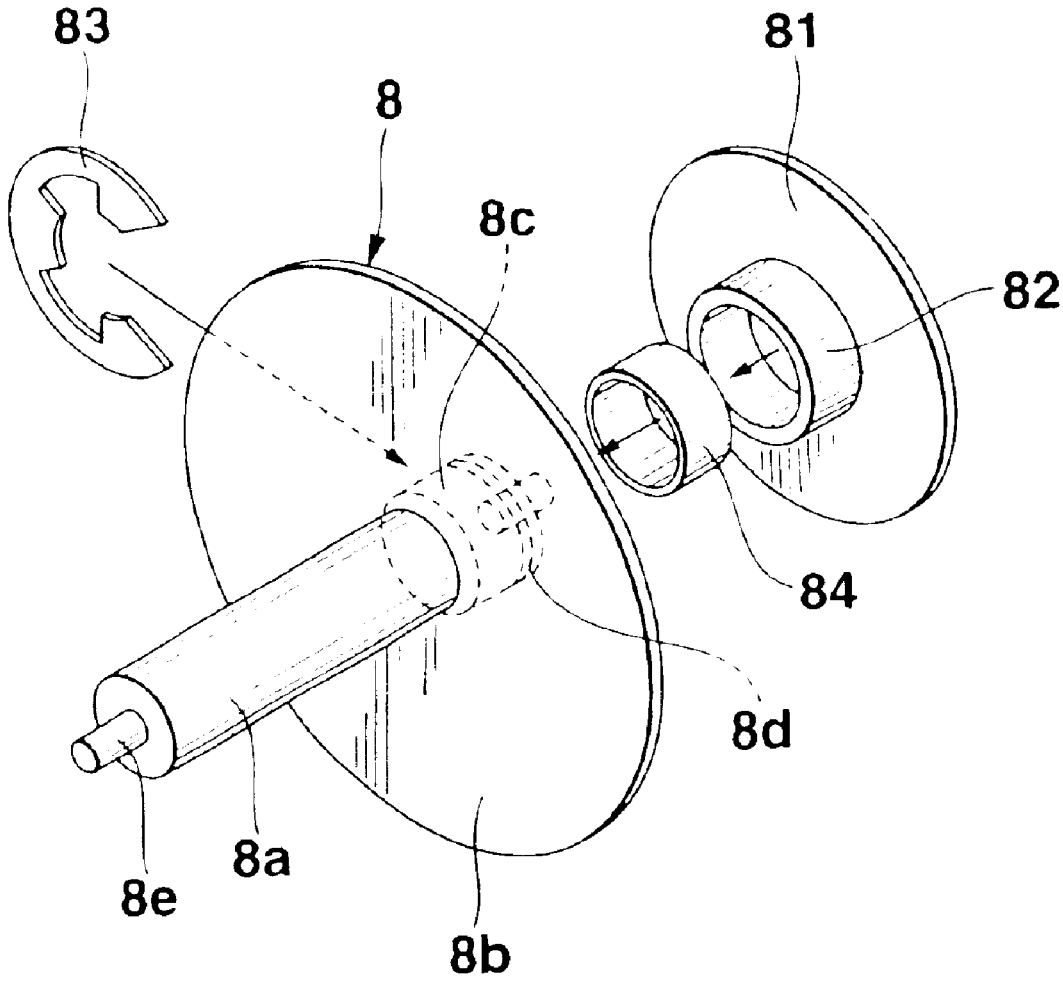
FIG. 4 is a disassembled perspective view of another example 2 of the structure of the paper winding mechanism.

As shown in FIG. 4, this mechanism includes a frictional sleeve 84 provided between the outer periphery of the larger shaft end 8*c* of the winding pulley 8 and the inner periphery of hollow cylindrical portion 82 of the frictional wheel 81 that fits over the larger shaft end 8*c* of the winding pulley 8 to thereby allow adjustment of a frictional force between the pulley 8 and the frictional wheel 81 in the structure of the example 1 of the paper winding mechanism of FIGS. 1–3.

<Structure of the Printer Unit>

Figure 5:
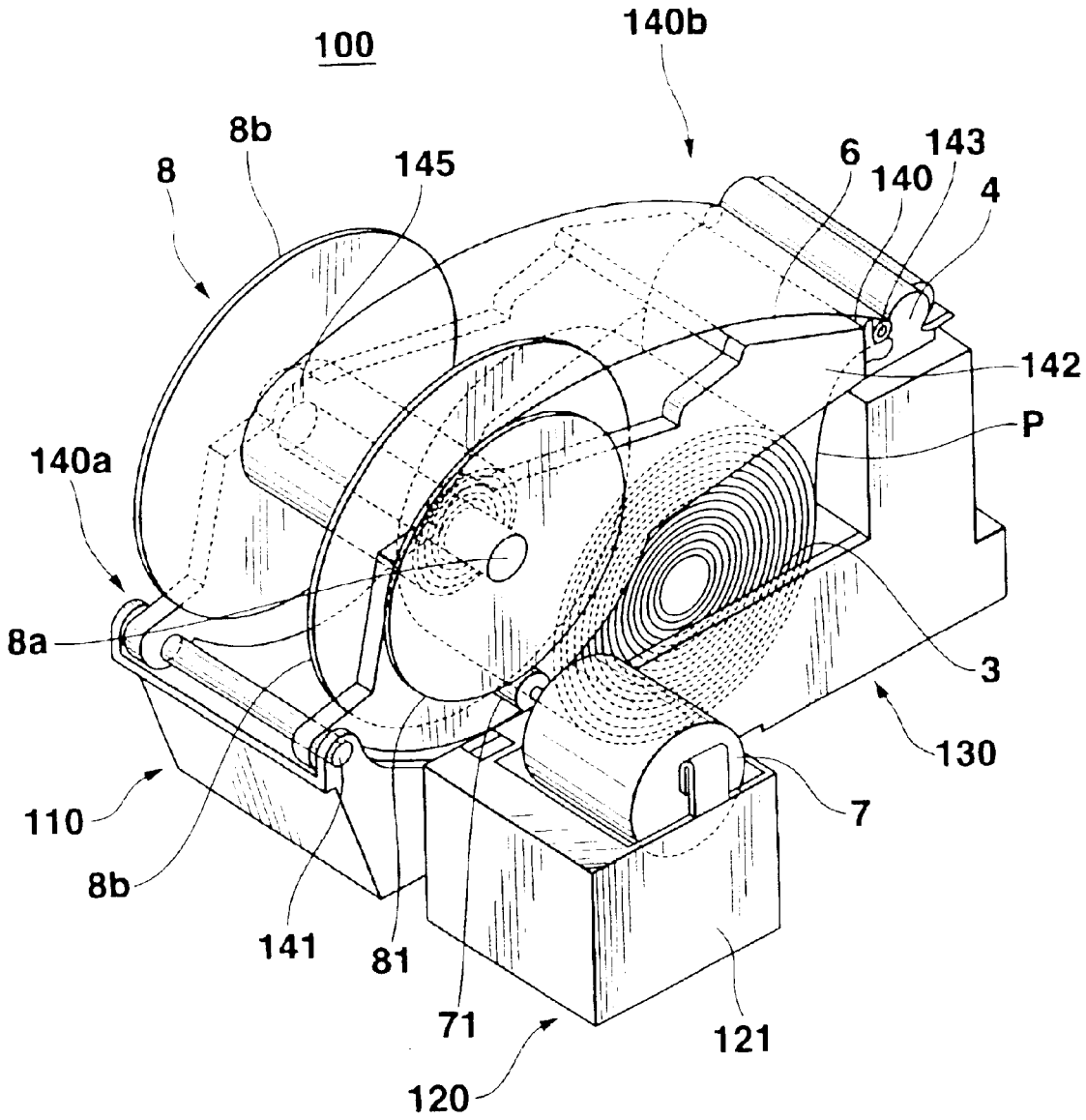
FIG. 5 is a schematic perspective view of a printer unit as a first embodiment of the present invention.
Figure 6:
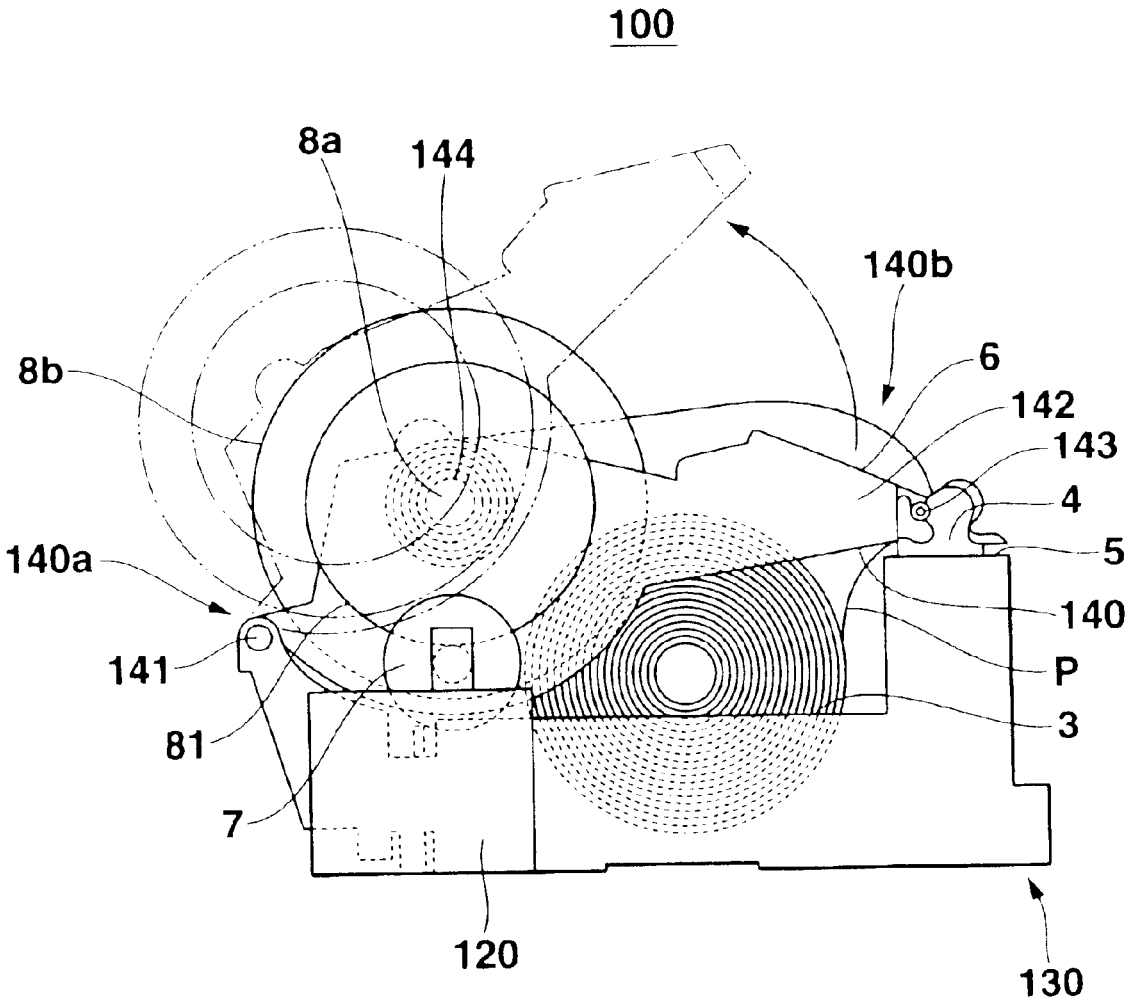
FIG. 6 is a side view of an essential part of the printer unit of FIG. 5.

As shown in FIGS. 5 and 6, the printer unit 100 comprises a body 110 having a paper shed 3, a journal printer 4 fixed to the body 110, a motor case 120 fixed to the body 110 and in which a winding motor 7 is housed, and a turning arm 140 that supports the winding pulley 8 and the frictional wheel 81.

The body 110 includes a case 130 over which the turning arm 140 is supported by a pivot 141 at its end 140*a*.

The motor case 120 is attached integrally to one side of the body case 130 and partially and houses the winding motor 7 therein.

The turning arm 140 includes a writing stand 6 is provided at ends 140*b* of a pair of side plates 142 engageable with the journal printer 4.

As described above, the winding pulley 8 and the frictional wheel 81 are assembled with the turning arm 140. More particularly, the winding pulley 8 has the hollow cylindrical portion 82 of the frictional wheel 81 rotatably received in 144 in a recess provided on one side plate 142 of the turning arm 140. The winding pulley 8 also has the other shaft end 8*e* rotatably received in a slit 145 provided in the other side plate 142 of the turning arm 140 and also rotatably fitted in a hole (not shown) in the flange 8*b*. Thus, when the journal paper P is wound fully as a roll around the winding pulley 8, the pulley 8 with its roll can be moved upward to thereby remove the flange 8*b* from the pulley and the roll of journal paper can be pulled laterally away out of the pulley.

The frictional wheel 81 is assembled rotatably at the end of the pulley shaft 8*a*. The detailed structures of the pulley 8 and the frictional wheel 81 of the paper winding mechanism are similar to those of the example 1 or 2.

The journal paper of the roll P is printed by the journal printer 4 on the printer fixing stand 5, wound by the pulley 8 provided on the turning arm 140 through the writing stand 6 on the turning arm 140, and then taken out as a roll.

As described above, in the printer unit, the body 110 has the paper shed 3 and the journal printer 4 fixed thereto. The body 10 also has the turning arm 140 with which the winding pulley 8 and the frictional wheel 81 are assembled. The motor case 120 in which the winding motor 7 is housed is provided integrally to the printer unit 100.

Therefore, maintenance work is achieved satisfactorily as follows: When maintenance such as repair/replacement of the winding mechanism, for example, due to abrasion of the rubber roller 71 is performed, such maintenance can be easily achieved in a short time by turning the turning arm 140 upward. Since the platen 143 is attached integrally to the turning arm 140, a roll of journal paper P can be easily set by turning the turning arm 140 upward. In addition, when the printer mechanism malfunctions defective, the printer unit 100 can be removed as a unit from the cash register to thereby set immediately a new printer unit 100 instead. The printer unit 100 can be attached removably as a unit to the cash register at one-touch operation.

A second embodiment of the printer unit 100 according to the present invention will be described next with reference to FIGS. 7–15. Also, in the second embodiment, the same reference numeral is used to denote the same element as that in the first embodiment and further description thereof will be omitted. A pair of hooks 131 is provided at a lower right end of a case 130 of a unit body 110 and respectively engaged disengageably in a pair of holes 231 formed in a top of a drawer 2 of the cash register 1. A hook 132 is provided on each of both sides of the case 130 at its lower edge and engaged disengageably in a corresponding hole 232 formed in the top of the drawer 2.

In assembly, first, the pair of hooks 131 is inserted into and engaged with the holes 231, and each hook 132 is then inserted into and engaged with the hole 232 on the respective one of the sides of the case 130. Thus, the unit body 110 is assembled with the drawer 2. Conversely, by disengaging and pulling the pair of hooks 131 from the pair of holes 231, and then the hookes 132 from the respective holes 232, the unit body 110 is removed from the drawer 2.

Figure 7:
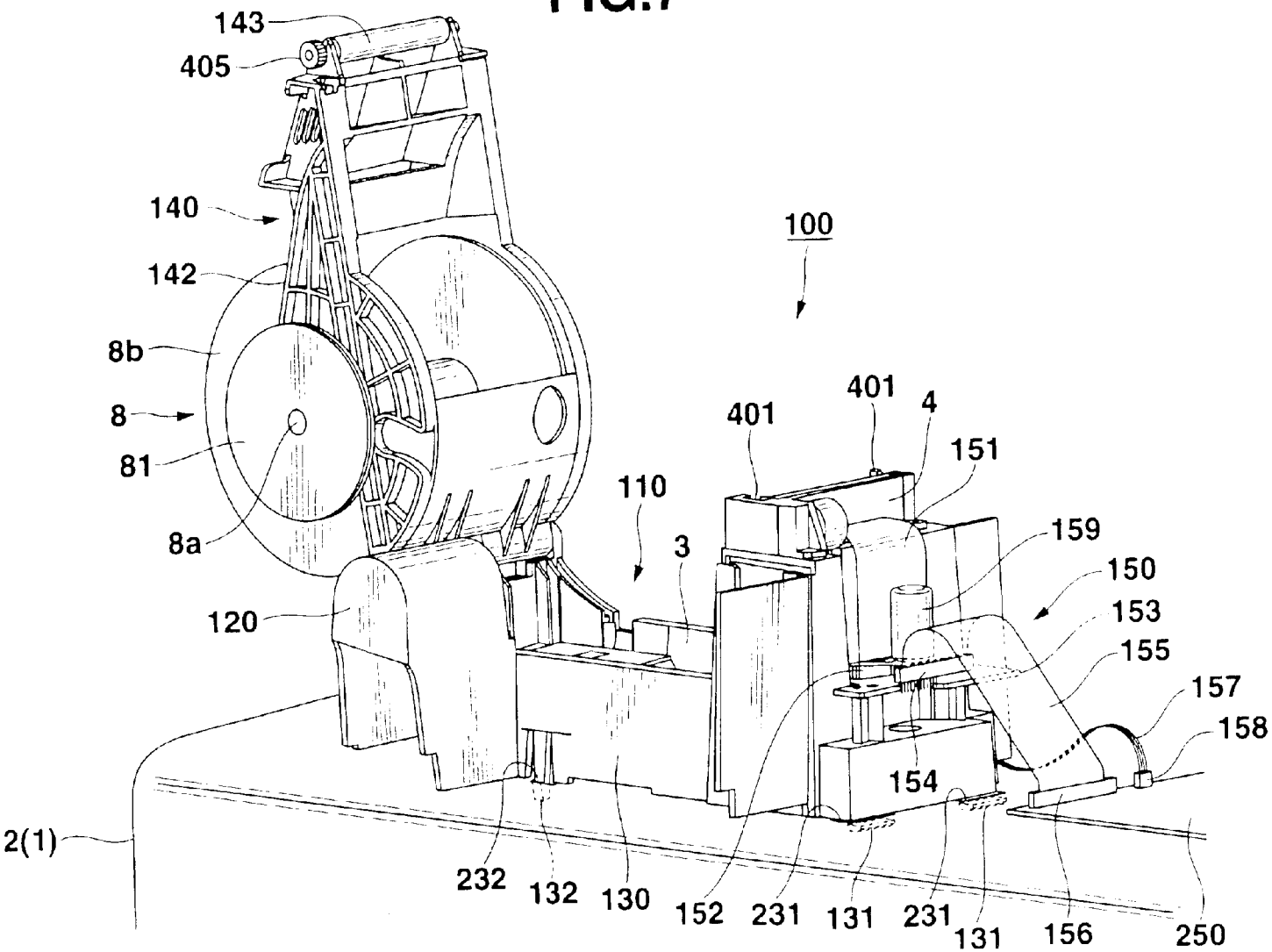
FIG. 7 is a schematic perspective view of a printer unit as a second embodiment of the present invention attached to a device with a turning arm turned so as to extend vertically.

The unit body 110 has an electrical connection 150 connectable/removable to/from a control board 250 (FIG. 7) disposed on the drawer 2 of the cash register 1. As shown in FIG. 7, a connector 152 for a film board 151 extending from the journal printer 4 at an end of the case 130 is connected to a relay board 153 fixed to an end of the case 130. A film board 155 is connected to the relay board 153 through a connector 154. A connector 156 for the film board 155 is connected to the control board 250. A connector 158 for wiring 157 extending from below the case 130 is connected to the control board 250.

By such electrical connection 150, power supply and drive control to the control board 250 of the cash register, the journal printer 4 and the winding motor 7 is ensured. In addition, a battery (not shown) received in a battery shed 310 supplies power to the control board 250 for backup of a memory. Electric parts such as capacitor 159 are provided on the relay board 153.

Figure 8:
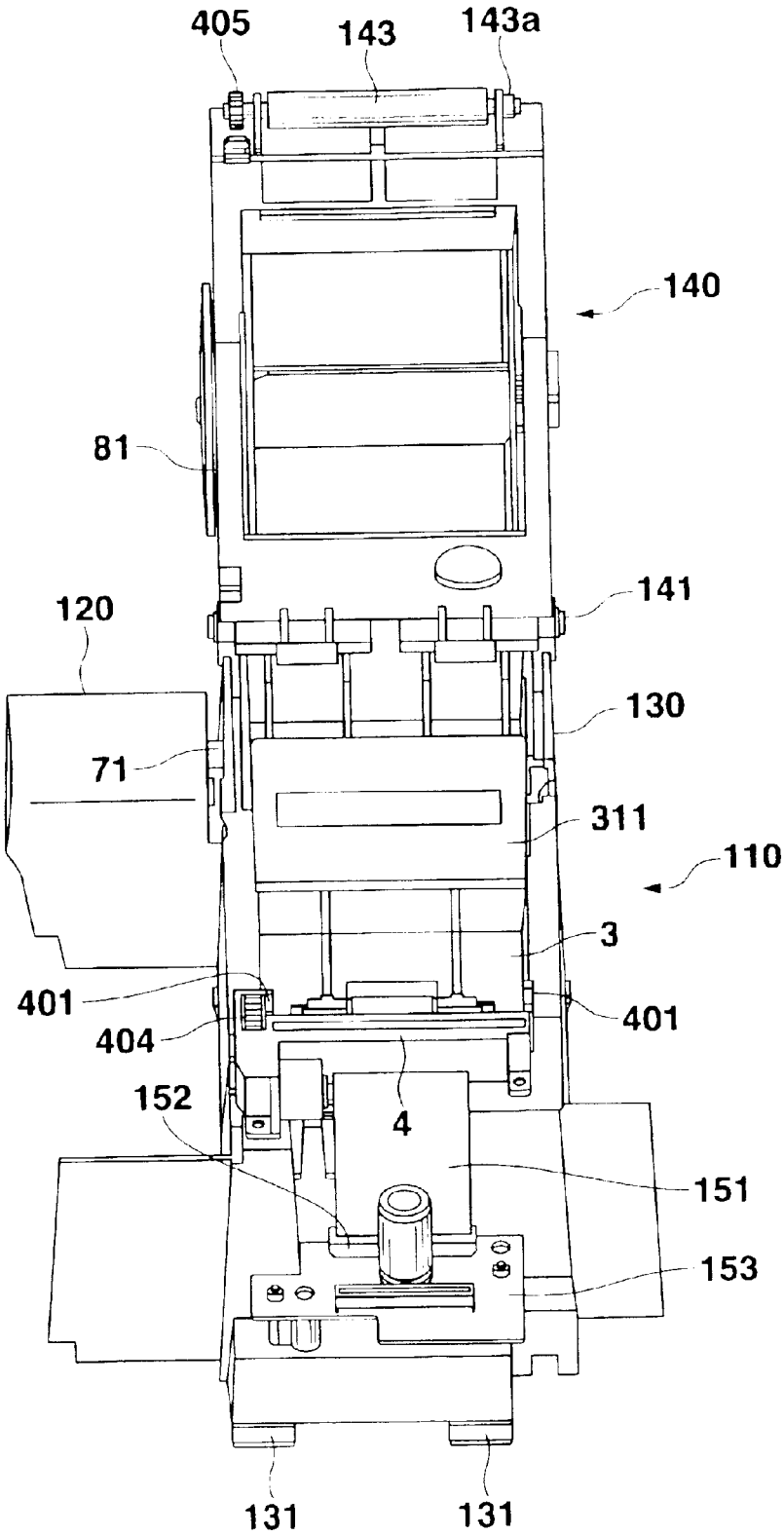
FIG. 8 is a schematic front view of the printer unit of FIG. 7.
Figure 9:
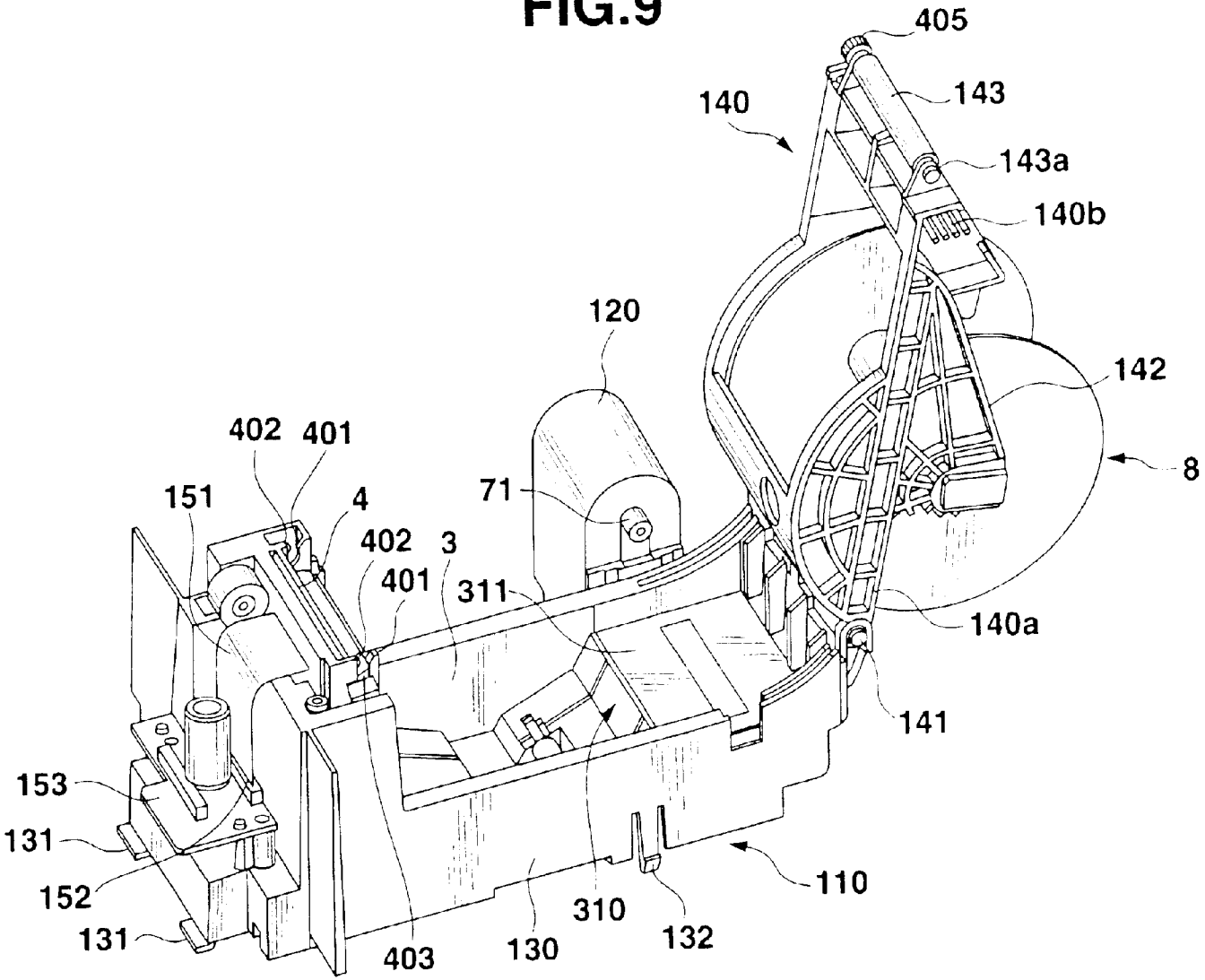
FIG. 9 is schematic perspective view of the printer unit of FIG. 7 as viewed from another side.

As shown in FIGS. 8 and 9, a recess 401 is formed on each of the sides of the printer 4 on the case 130 and houses therein an engaging spring 401 and a sensor 403.

When the platen 143 is engaged at its opposite shaft ends 143*a* in the recesses 401 and prevented from slipping off from the recesses by the relevant engaging springs 402, the platen 143 side of the turning arm 140 is secured to the journal printer 4 of the case 130. At this time, the sensor 403 senses that the platen 143 is set on the journal printer 4 due to the presence of the platen shaft 143*a*.

A gear 404 (FIG. 8) is disposed at one side of the journal printer 4 so as to be rotated by the journal printer. A gear 405 is provided at one end of the platen shaft 143 so as to be engageable with the gear 404 at the side of the journal printer 4.

Figure 11:
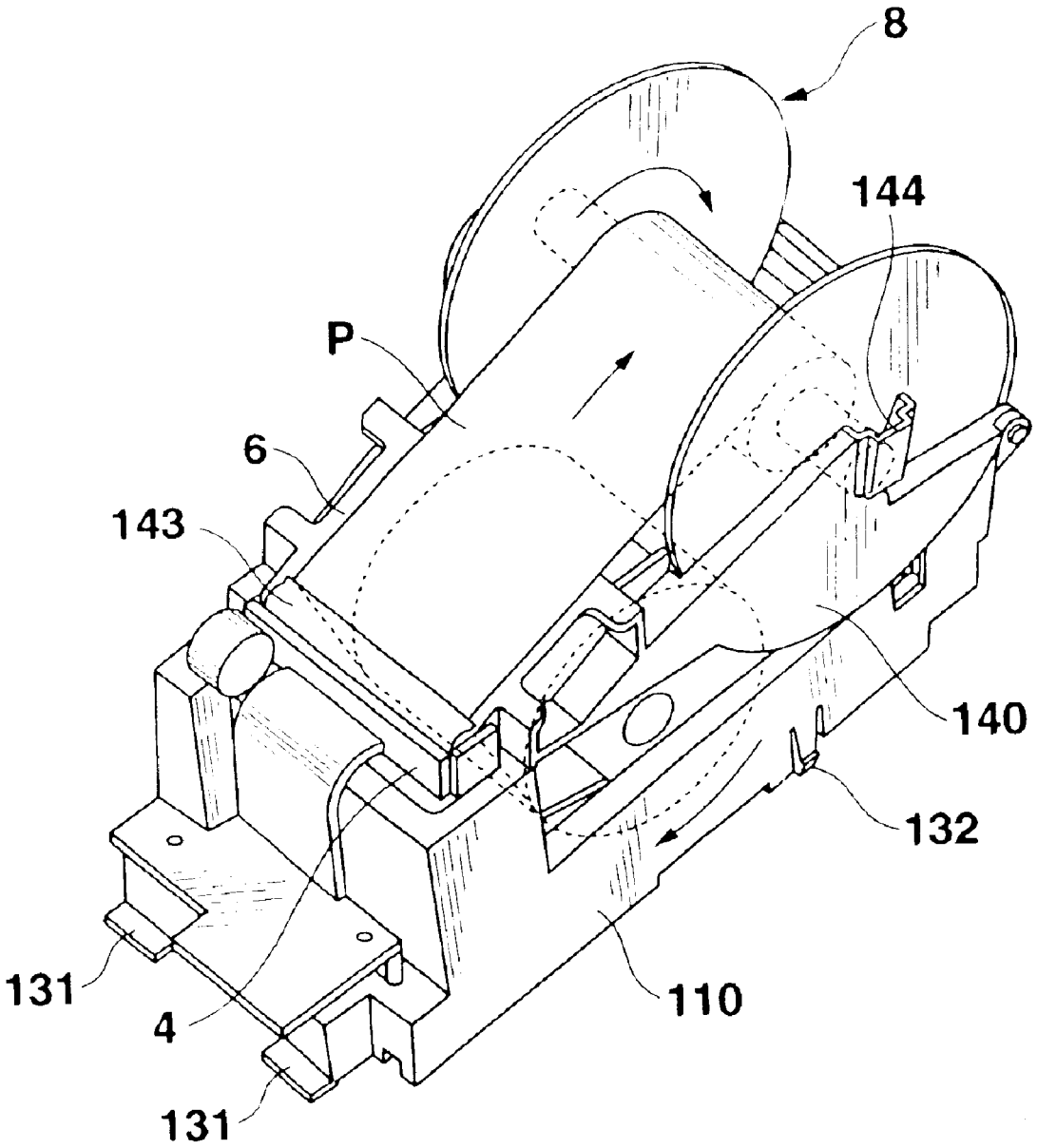
FIG. 11 illustrates the rotating direction of a winding pulley assembled in the printer unit and the winding direction of printing paper.
Figure 12:
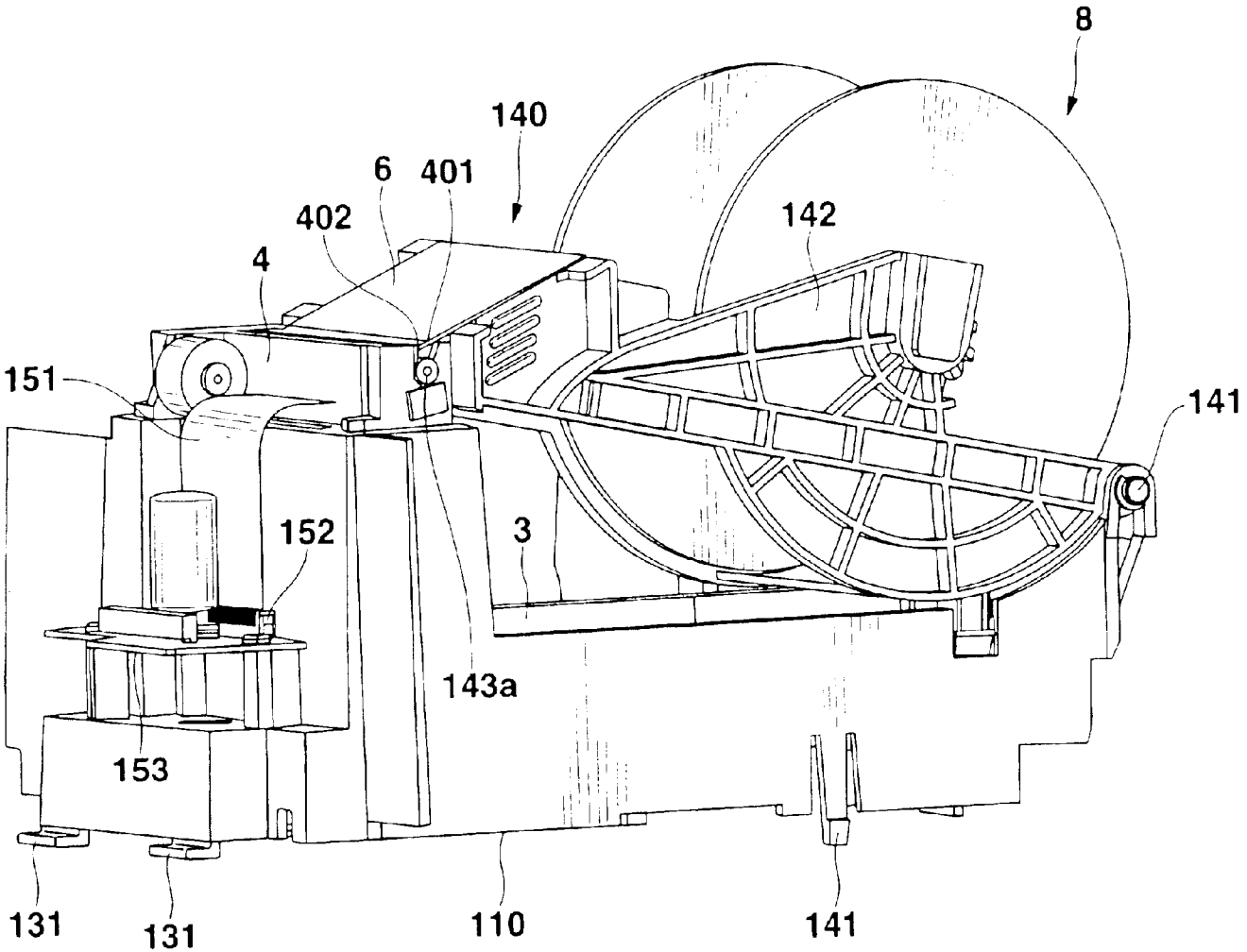
FIG. 12 is an enlarged view of the printer unit of FIG. 9 with its turning arm laid over the unit body.

By the meshing of the gears 404 and 405, paper of a roll P set in the paper shed 3 of the case 130 is fed by rotation of the platen 143 on the journal printer 4 and then wound by the winding pulley 8, as shown in FIG. 11.

Figure 10:
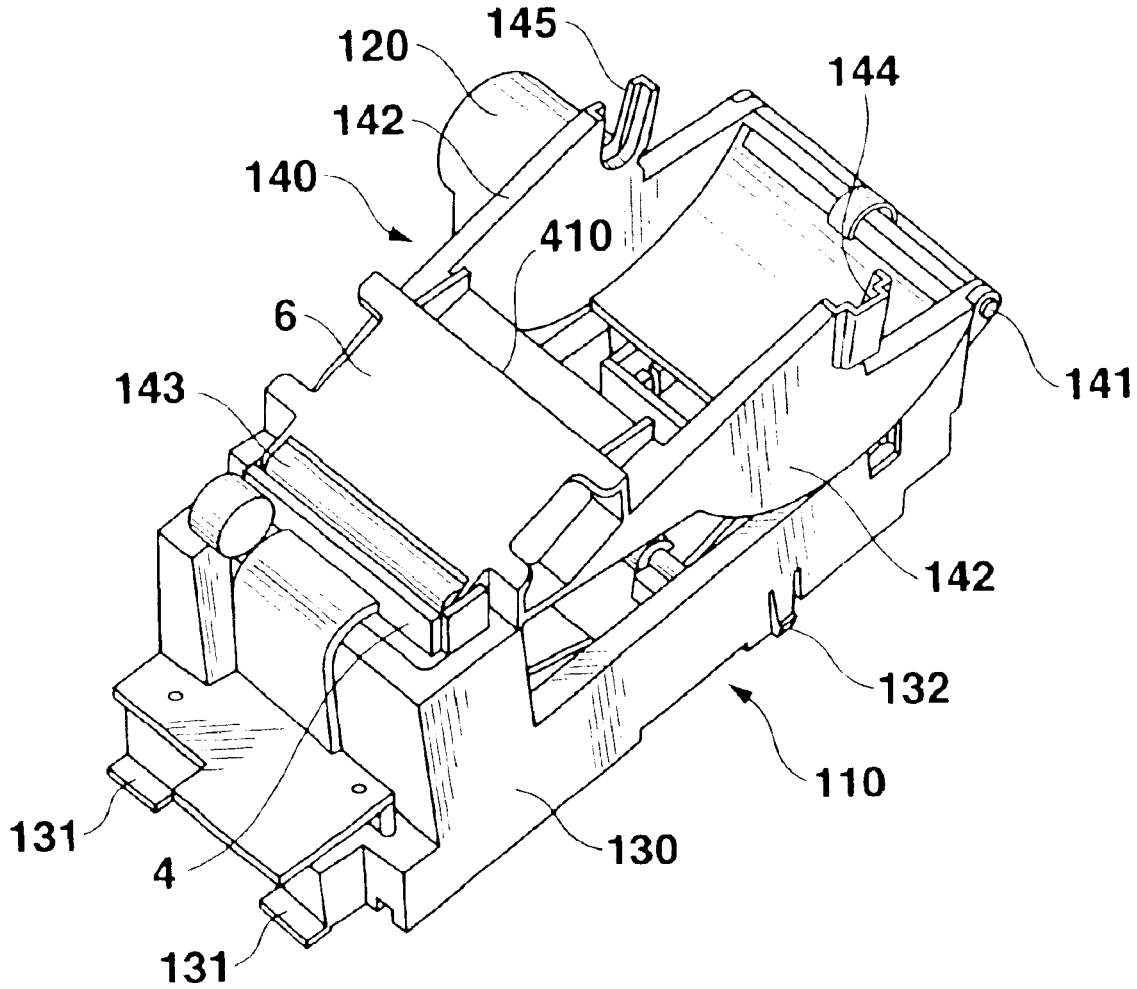
FIG. 10 schematically illustrates the printer unit with its turning arm laid over the unit body.
Figure 13:
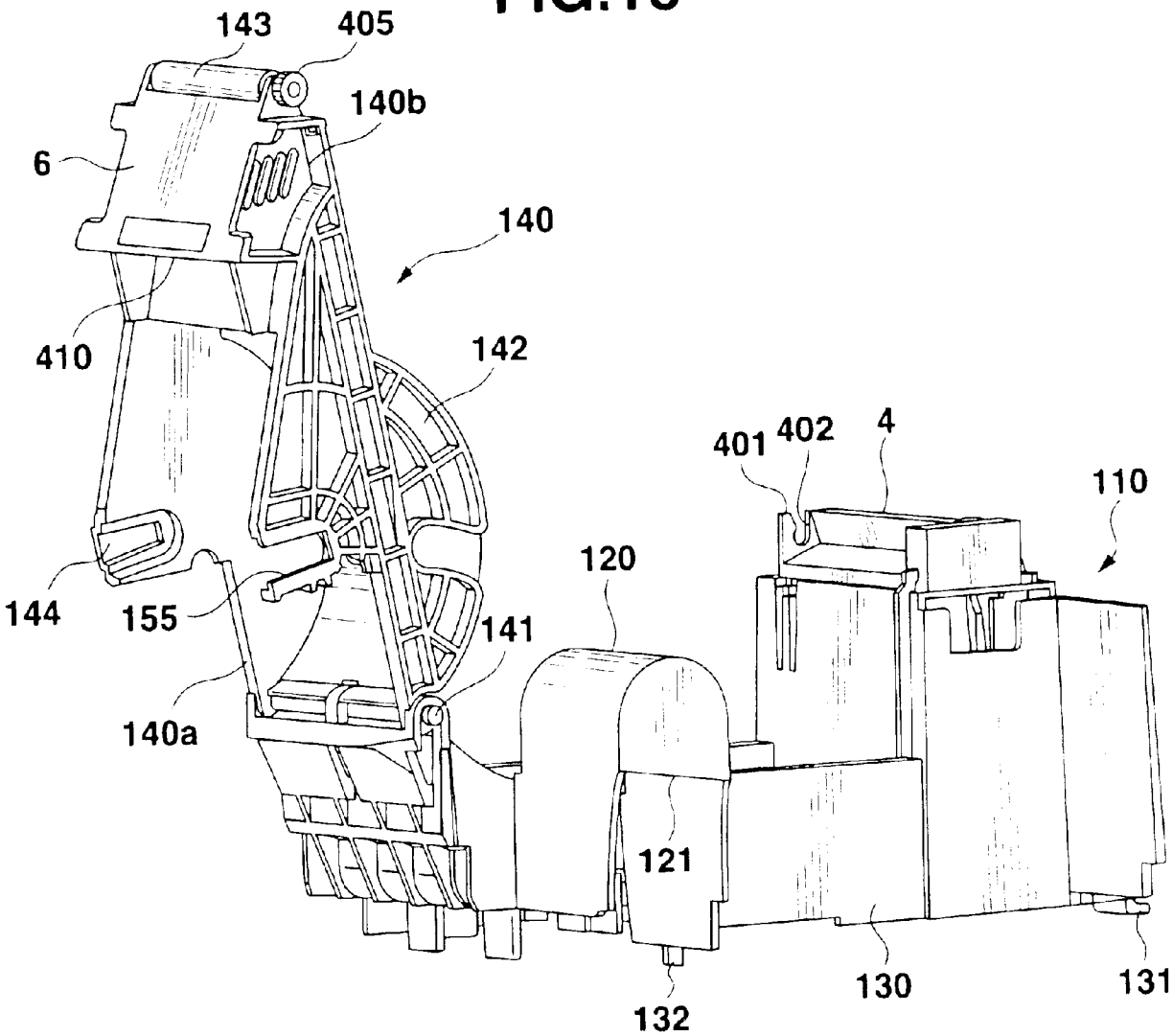
FIG. 13 is a schematic perspective view of the printer unit of FIG. 9 with the turning arm upstanding, as viewed from the side of the turning arm.

As shown in FIGS. 10 and 13, the back of the writing stand 6 provided on the turning arm 140 has a handle 410 that is capable of being held by fingers of the user to turn the turning arm 140 upward from the case 130 (unit body 110). Conversely, the upward turned arm 140 can be turned so as to overlie on the case 130 by operating the handle 410.

Figure 14:
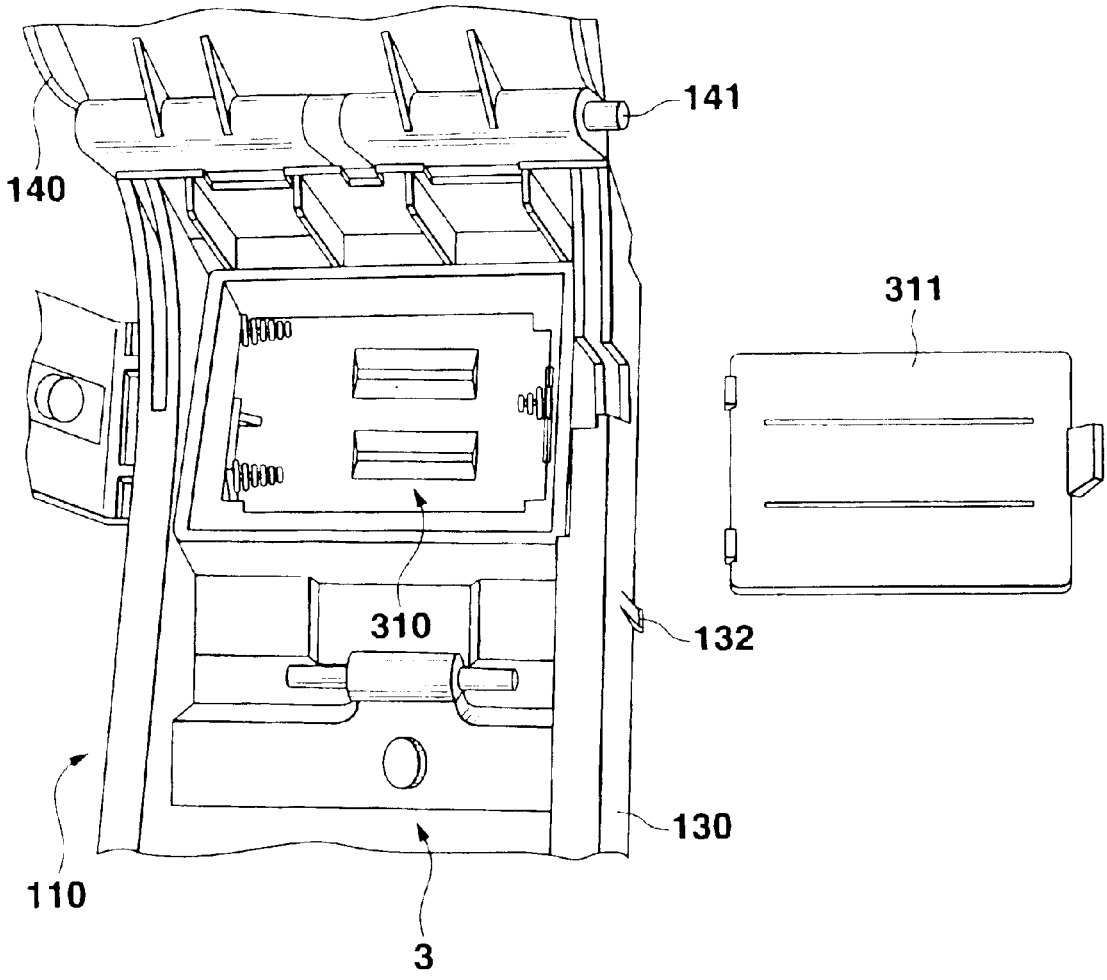
FIG. 14 shows a battery shed provided in the unit body with a cover shown as removed.

As shown in FIG. 14, the battery shed 310 with an openable cover is provided in the body case 130 on the opposite side of the paper shed 3 from the journal printer 4.

Figure 15:
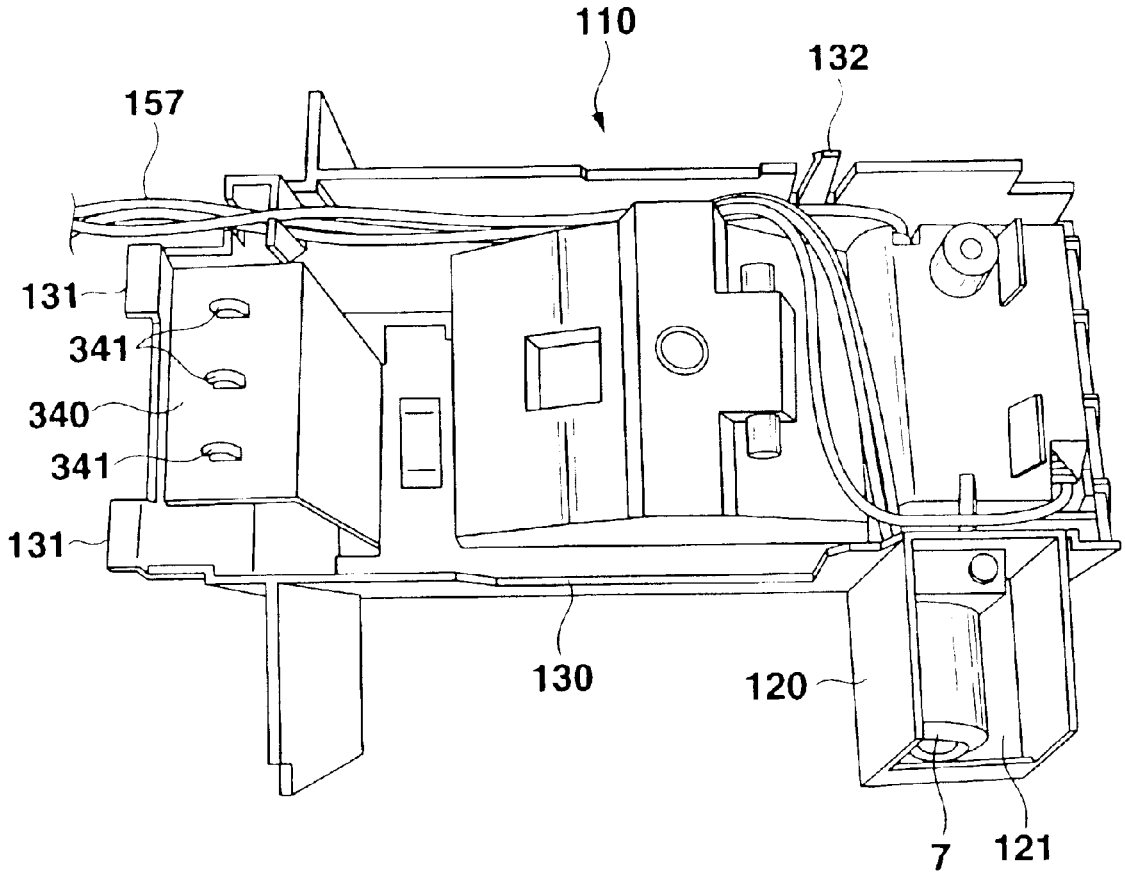
FIG. 15 is a schematic perspective view of the unit body as viewed from below.
Figure 16:
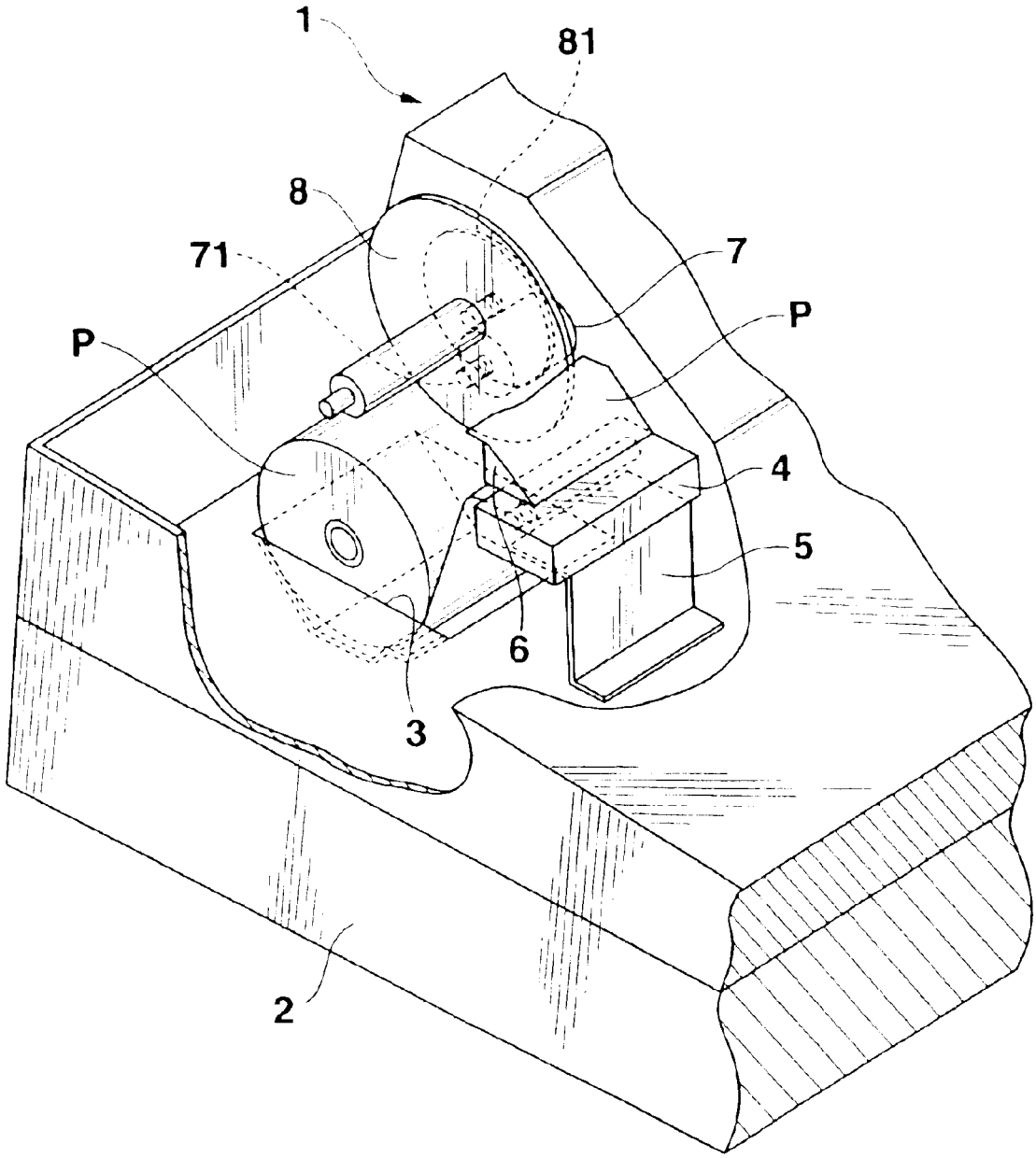
FIG.16 PRIOR ART
FIG. 16 is a perspective view of a conventional journal paper winding mechanism provided in a cash register.
Figure 17:
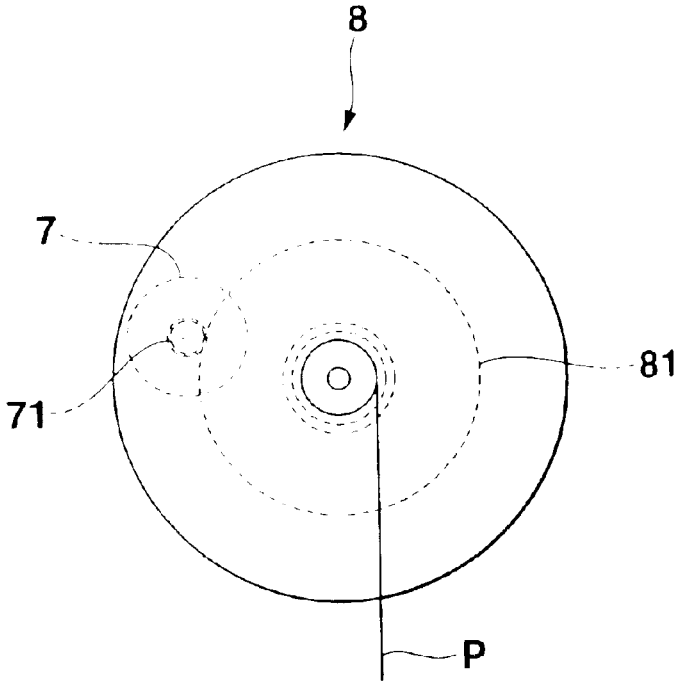
FIG.17 PRIOR ART
FIG. 17 is a side view of the journal paper winding mechanism of FIG. 16.
Figure 18:
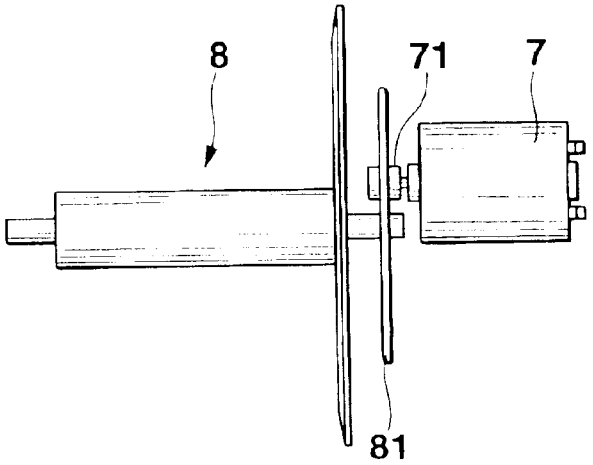
FIG.18 PRIOR ART
FIG. 18 is a plan view of the journal paper winding mechanism of FIG. 16.

As shown in FIG. 15, a grounding plate 340 is provided on the bottom of the unit body 110 below the journal printer 4 with springs 341 grounded along with the drawer being provided on the grounding plate 340 so as to cause static charges on the journal printer 4 to escape to the drawer for preventing malfunction of the printer. Pieces of electric wires 157 are provided for feeding electric power from the battery to the memory for backup purposes and from a power supply (not shown) to the motor 7 for driving purposes.

While in the embodiment the E-like ring is used to prevent the frictional wheel from slipping off from the end of the shaft of the winding pulley 8, the present invention is not limited to this particular case. For example, a plastic snap fit may be used instead.

Even in the mechanism for transmitting rotation from the winding motor to the winding pulley, a gear chain may be used instead of the frictional wheel and rubber roller. The specified details of the structure of the printer unit may be appropriately changeable, of course.

What is claimed is:

1. A printer unit mountable on a cash register and electrically coupled to a controller of the cash register, the printer unit comprising:

a body having a paper shed for storing a roll of paper;

a journal printer provided on the body for printing on paper fed from the paper shed;

a fixer provided at a lower end of the body for removably fixing the body to the cash register;

a turnable arm pivoted at one end on the body after the paper shed so as to be turned to a position where the arm is placed over the journal printer;

a platen provided on a free end of the turnable arm for feeding the paper from the paper shed toward the journal printer when the arm is placed over the journal printer;

a winding pulley provided on the arm proximate one end of the arm for winding paper printed by the journal printer and fed from the platen over the turnable arm; and a connector for electrically coupling the printer unit to the cash register.

2. The printer unit according to claim 1, further comprising a motor provided on the body for rotating the winding pulley.

3. The printer unit according to claim 2, further comprising a rotation transmission member rotatably assembled with the winding pulley so as to be rotatable relative to the winding pulley for transmitting rotation of the motor to the winding pulley.

4. The printer unit according to claim 1, wherein the platen has a shaft engageable in a groove provided on the body for fixing the arm to the body when the arm is placed over the journal printer.

5. The printer unit according to claim 1, further comprising a gear provided on the platen so as to mesh with a second gear driven on the printer side.

6. The printer unit according to claim 1, further comprising a battery shed provided on the unit body on the opposite side of the paper shed from the printer.

7. The printer unit according to claim 1, wherein the fixer comprises a plurality of hooks provided on the body for engaging/disengaging with/from the cash register.

8. The printer unit according to claim 1, further comprising a grounding member provided on the body for allowing static charges to escape from the body toward the cash register.

9. A printer unit mountable on a drawer provided on top of a cash register and electrically coupled to a controller of the cash register, the printer unit comprising:

a body having a paper shed for storing a roll of paper;

a journal printer provided on the body for printing on paper fed from the paper shed;

a fixer provided at a lower end of the body for removably fixing the body to the drawer;

a turnable arm pivoted at one end on the body after the paper shed so as to be turned to a position where the arm is placed over the journal printer;

a platen provided on a free end of the turnable arm for feeding the paper from the paper shed toward the journal printer when the arm is placed over the journal printer; and a pulley provided on the arm proximate one end of the arm for winding paper printed by the journal printer and fed from the platen over the turnable arm.

10. A printer unit mountable on a cash register and electrically coupled to a controller of the cash register, the printer unit comprising:

a body having a paper shed for storing a roll of paper;

a journal printer provided on the body for printing on paper fed from the paper shed;

a turnable arm pivoted at one end on the body after the paper shed so as to be turned to a position where the arm is placed over the journal printer;

a platen provided on a free end of the turnable arm for feeding the paper from the paper shed toward the journal printer when the arm is placed over the journal printer;

a pulley provided on the arm proximate one end of the arm for winding paper printed by the journal printer and fed from the platen over the turnable arm;

a writing stand provided on the arm between the platen and the pulley; and a fixer provided at a lower end of the body for removably fixing the body to the cash register.

11. The printer unit according to claim 10, wherein the writing stand on the turnable arm has a handle provided on the back thereof, the handle being held by a user to turn the turnable arm.

* * * * *